US009309070B2

(12) United States Patent
Tanio

(10) Patent No.: US 9,309,070 B2
(45) Date of Patent: Apr. 12, 2016

(54) PAPER FEEDER AND IMAGE FORMING APPARATUS WITH THE SAME

(71) Applicant: KYOCERA Document Solutions Inc., Osaka (JP)

(72) Inventor: Koji Tanio, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/088,872

(22) Filed: Nov. 25, 2013

(65) Prior Publication Data

US 2014/0145392 A1 May 29, 2014

(30) Foreign Application Priority Data

Nov. 28, 2012 (JP) ..... 2012-259585

(51) Int. Cl.
*B65H 1/26* (2006.01)
*B65H 1/04* (2006.01)
*B65H 3/56* (2006.01)

(52) U.S. Cl.
CPC .. *B65H 3/56* (2013.01); *B65H 1/04* (2013.01); *B65H 1/266* (2013.01); *B65H 2405/113* (2013.01); *B65H 2405/313* (2013.01)

(58) Field of Classification Search
CPC ..... B65H 1/266; B65H 1/04; B65H 3/56; B65H 3/46; B65H 3/0684; B65H 3/0669
USPC ..... 271/164, 162, 145, 121, 122, 127
See application file for complete search history.

(56) References Cited

U.S. PATENT DOCUMENTS 7,871,067 B2 * 1/2011 Lim ..... 271/9.13
2009/0309295 A1 12/2009 Taguchi
2013/0168920 A1 * 7/2013 Shin ..... B65H 3/0607 271/117

FOREIGN PATENT DOCUMENTS

JP S62-132048 U 8/1987
JP 63212629 A * 9/1988
JP S63-212629 9/1988
JP 03128833 A * 5/1991

(Continued)

OTHER PUBLICATIONS

Extended European Search Report dated Dec. 11, 2014, in European Application No. 13193899.5.

(Continued)

*Primary Examiner* — Luis A Gonzalez
(74) *Attorney, Agent, or Firm* — Knobbe, Martens, Olson & Bear LLP

(57) ABSTRACT

A paper feeder includes: a cassette including a sheet container; a sheet conveyance path along which a sheet is conveyed in a sheet conveyance direction extending along a direction of loading/unloading of the cassette into/from an apparatus body; a paper feed roller configured to convey the sheet in the sheet conveyance direction; an opposed member, opposite to the paper feed roller, forming together with the paper feed roller a paper feed nip where the sheet enters; and a restricting member configured to, in a first state where the cassette is unloaded, close off a portion of the sheet conveyance path upstream of the paper feed nip in the sheet conveyance direction to restrict the sheet in the sheet container from entering the paper feed nip and, in a second state where the cassette is loaded and the paper feed roller is ready to convey the sheet, open the sheet conveyance path.

13 Claims, 8 Drawing Sheets

(56) References Cited

FOREIGN PATENT DOCUMENTS

| | | | | |
|---|---|---|---|---|
| JP | H09-249319 | | | 9/1997 |
| JP | 2002-154676 | A | | 5/2002 |
| JP | 2005-320133 | | | 11/2005 |
| JP | 2005-320133 | A | | 11/2005 |
| JP | 2005320133 | A | * | 11/2005 |
| JP | 2007-001685 | | | 1/2007 |
| JP | 2007001685 | A | * | 1/2007 |
| JP | 2011-068476 | A | | 4/2011 |

OTHER PUBLICATIONS

Notice of Rejection mailed by Japan Patent Office on Mar. 3, 2015 in the corresponding Japanese patent application No. 2012-259585—2 pages.

* cited by examiner

PAPER FEEDER AND IMAGE FORMING APPARATUS WITH THE SAME

INCORPORATION BY REFERENCE

This application claims priority to Japanese Patent Application No. 2012-259585 filed on Nov. 28, 2012, the entire contents of which are incorporated by reference herein.

BACKGROUND

The present disclosure relates to a paper feeder configured to feed sheets and an image forming apparatus with the paper feeder.

As an example of a paper feeder operable to feed sheets, a paper feeder fitted in an image forming apparatus is known. The paper feeder is composed of a sheet cassette capable of being loaded into and unloaded from an apparatus body of the image forming apparatus, a pick-up roller, a paper feed roller, and a retard roller. The pick-up roller, the paper feed roller, and the retard roller are mounted to the apparatus body. The sheet cassette can contain sheets. When a lift plate mounted on the sheet cassette moves up, the uppermost of the sheets in the sheet cassette is pressed against the pick-up roller. Then, the pick-up roller is rotated, so that the sheet is fed in a sheet conveyance direction.

The sheet fed forward by the pick-up roller is introduced into a paper feed nip formed by the paper feed roller and the retard roller. With the rotation of the paper feed roller, the sheet is further conveyed downstream in the sheet conveyance direction.

When the sheet cassette is inserted hard into the apparatus body with sheets stacked in the sheet cassette, some of the sheets may enter the paper feed nip. In addition to this, if the sheet cassette is pulled out of the apparatus body with some sheets entering the nip in the apparatus body (in the event of multifeed failure), the sheets will be stuck in the apparatus body.

As a solution to the above problem, there is known a technique in which the movement of sheets in the apparatus body is restricted by an interlocking mechanism disposed across the sheet cassette and the apparatus body.

SUMMARY

A technique further modified from the above known technique is proposed as an aspect of the present disclosure.

A paper feeder according to an aspect of the present disclosure includes a cassette, a sheet conveyance path, a paper feed roller, an opposed member, and a restricting member.

The cassette is capable of being loaded into and unloaded from an apparatus body in a predetermined direction and is provided internally with a sheet container in which sheets are to be contained.

The sheet conveyance path is extended from the sheet container and the sheet is to be conveyed along the sheet conveyance path in a sheet conveyance direction which extends along a direction of loading and unloading of the cassette.

The paper feed roller is mounted to the cassette at an entrance of the sheet conveyance path and configured to convey the sheet in the sheet conveyance direction.

The opposed member is disposed opposite to the paper feed roller and forms, together with the paper feed roller, a paper feed nip where the sheet enters.

The restricting member is configured to, in a first state where the cassette is unloaded from the apparatus body, close off a portion of the sheet conveyance path upstream of the paper feed nip in the sheet conveyance direction to restrict the sheet in the sheet container from entering the paper feed nip and, in a second state where the cassette is loaded in the apparatus body and the paper feed roller is ready to convey the sheet, open the sheet conveyance path to allow the sheet enter the paper nip.

An image forming apparatus according to another aspect of the present disclosure includes the aforementioned paper feeder, an apparatus body, and an image forming section.

The apparatus body is capable of loading of the cassette therein.

The image forming section is disposed in the apparatus body and configured to form an image on the sheet conveyed by the paper feed roller.

DETAILED DESCRIPTION

Figure 1:
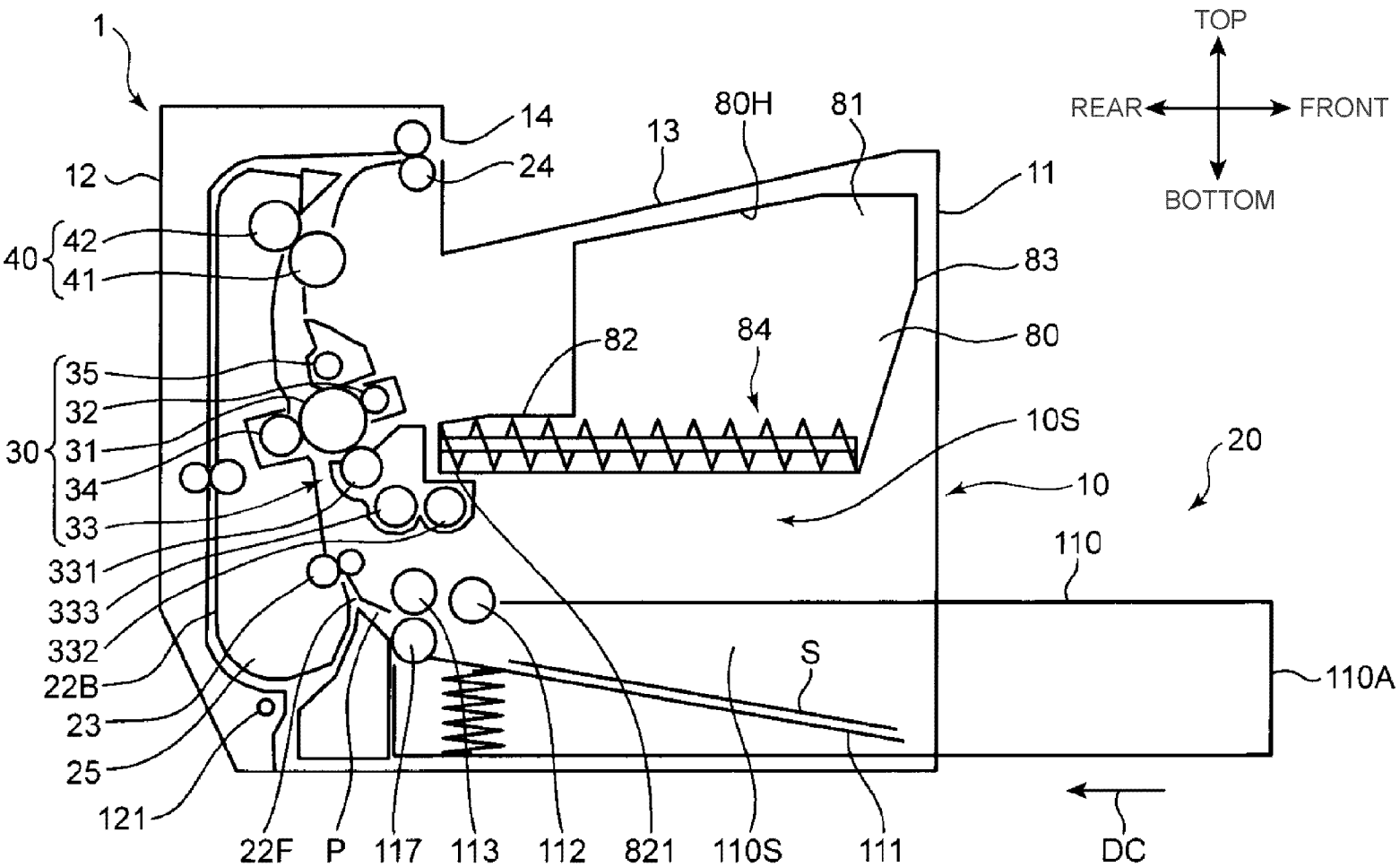
FIG. 1 is a cross-sectional view schematically showing an internal structure of an image forming apparatus according to an embodiment of the present disclosure.

Hereinafter, a detailed description will be given of an embodiment of the present disclosure with reference to the drawings. FIG. 1 is a sectional side view showing the internal structure of an image forming apparatus 1 according to an embodiment of the present disclosure. Here, a black and white printer is exemplified as the image forming apparatus 1. However, the image forming apparatus may be a copier, a facsimile machine, a multifunction peripheral having these functions or an image forming apparatus capable of forming color images.

The image forming apparatus 1 includes a body housing 10 (apparatus body) having an approximately cuboid housing structure and further includes an image forming section 30, a fixing section 40, a toner container 80, and a paper feed section 20 all of which are housed in the body housing 10.

The body housing 10 includes a front cover 11 on the front side and a rear cover 12 on the rear side. When the front cover 11 is opened, the toner container 80 is exposed on the front side. Thus, the user can take out the toner container 80 from the front side of the body housing 10 when the toner container 80 is out of toner. The rear cover 12 is a cover that can be opened in the event of a sheet jam and during maintenance. Each of the image forming section 30 and the fixing section 40 can be taken out as a unit from the rear side of the body housing 10 by opening the rear cover 12. Various devices for use in performing image formation are disposed in the interior space 10S defined by the front cover 11, the rear cover 12, and a paper output section 13.

The image forming section 30 performs an image forming process for forming a toner image on a sheet forwarded from the paper feed section 20. The image forming section 30 includes a photosensitive drum 31 and further includes a charging device 32, an exposure device (not seen in FIG. 1), a developing device 33, a transfer roller 34, and a cleaning device 35 all of which are disposed around the photosensitive drum 31.

The photosensitive drum 31 has a rotation axis and includes a cylindrical surface rotatable about the rotation axis. An electrostatic latent image can be formed on the cylindrical surface and a toner image corresponding to the electrostatic latent image can be carried on the cylindrical surface. An example of the photosensitive drum 31 that can be used is a photosensitive drum in which an amorphous silicon (a-Si) based material is used as a photosensitive material.

The charging device 32 is configured to uniformly charge the surface of the photosensitive drum 31 and includes a charging roller held in contact with the photosensitive drum 31.

The cleaning device 35 includes an unshown cleaning blade, cleans toner left behind on the peripheral surface of the photosensitive drum 31 having undergone the transfer of a toner image, and conveys the toner to an unshown recovery device.

The exposure device includes a laser light source and optical components, such as a mirror and a lens, and is configured to irradiate the peripheral surface of the photosensitive drum 31 with light modulated based on image data given by an external device, such as a personal computer, to form an electrostatic latent image. The developing device 33 supplies toner to the peripheral surface of the photosensitive drum 31 in order to develop the electrostatic latent image on the photosensitive drum 31 to form a toner image. The developing device 33 includes: a developing roller 331 capable of carrying toner to be supplied to the photosensitive drum 31; and first and second conveying screws 332, 333 configured to circulate and convey a developer while stirring the developer inside an unshown development housing.

The transfer roller 34 is a roller configured to transfer a toner image formed on the peripheral surface of the photosensitive drum 31 to a sheet. The transfer roller 34 is held in contact with the cylindrical surface of the photosensitive drum 31 to form a transfer nip. The transfer roller 34 is configured to be given a transfer bias of reverse polarity to the toner.

The fixing section 40 performs a fixing process for fixing the transferred toner image on the sheet. The fixing section 40 includes: a fixing roller 41 provided internally with a heat source; and a pressure roller 42 pressed against the fixing roller 41 and forming a fixing nip with the fixing roller 41. When the sheet S having the toner image transferred thereto is passed through the fixing nip, the toner image is fixed on the sheet S by heating from the fixing roller 41 and pressing from the pressure roller 42.

The toner container 80 is configured to store supply toner to be supplied to the developing device 33. The toner container 80 includes: a container body 81 serving as a main reservoir for supply toner; a tubular part 82 extending from a lower portion of a side surface of the container body 81; a lid member 83 covering another side surface of the container body 81; and a rotary member 84 built in the container 80 and operable to convey toner. When the rotary member 84 is driven into rotation, the supply toner stored in the toner container 80 is supplied into the developing device 33 through a toner outlet 821 provided in the bottom surface of the distal end of the tubular part 82. A container top 80H covering the toner container 80 from above is located below the paper output section 13.

The paper feed section 20 includes a cassette 110 capable of containing sheets S to be subjected to an image forming process. The cassette 110 includes a sheet container 110S in which a stack of sheets S can be contained, a lift plate 111 configured to lift up the stack of sheets S for the purpose of paper feed, and so on. Furthermore, a pick-up roller 112 and a paper feed roller 113 are mounted to the rear end of the cassette 110 for the purpose of conveyance of the sheet S. The sheet S is conveyed along a sheet conveyance path P extended from the cassette 110 and then introduced to an after-mentioned main conveyance path 22F extended in the interior of the body housing 10. The cassette 10 will be described in detail later.

The body housing 10 is provided internally with a main conveyance path 22F and a reverse conveyance path 22B in order to convey the sheet S. The main conveyance path 22F extends from the sheet conveyance path P of the paper feed section 20 via the image forming section 30 and the fixing section 40 to a paper output port 14 provided facing the paper output section 13 located at the top surface of the body housing 10. The reverse conveyance path 22B is a conveyance path for use to return the sheet S one side of which has already been subjected to printing to a position of the main conveyance path 22F upstream of the image forming section 30.

The main conveyance path 22F is extended to pass up from below through the transfer nip formed between the photosensitive drum 31 and the transfer roller 34. Furthermore, a registration roller pair 23 is disposed in the main conveyance path 22F upstream of the transfer nip. The sheet S is once stopped between the registration roller pair 23 to correct any skew and then forwarded therefrom to the transfer nip with a predetermined timing for image transfer. A plurality of conveyance rollers configured to convey the sheet S are disposed at various points of the main conveyance path 22F and reverse conveyance path 22B. For example, a paper output roller pair 24 as the conveyance rollers is disposed near the paper output port 14.

The reverse conveyance path 22B is formed between the outside surface of a reversing unit 25 and the inside surface of the rear cover 12 of the body housing 10. The transfer roller 34 and one roller of the registration roller pair 23 are mounted on the inside surface of the reversing unit 25. The rear cover 12 and the reversing unit 25 can be independently pivotally moved about the axis of a fulcrum member 121 provided at their lower ends. In the event of a sheet jam in the reverse conveyance path 22B, the rear cover 12 is opened. In the event of a sheet jam in the main conveyance path 22F or in the case of removal of any unit of the photosensitive drum 31 or the developing device 33 to the outside, not only the rear cover 12 but also the reversing unit 25 are opened.

Figure 2:
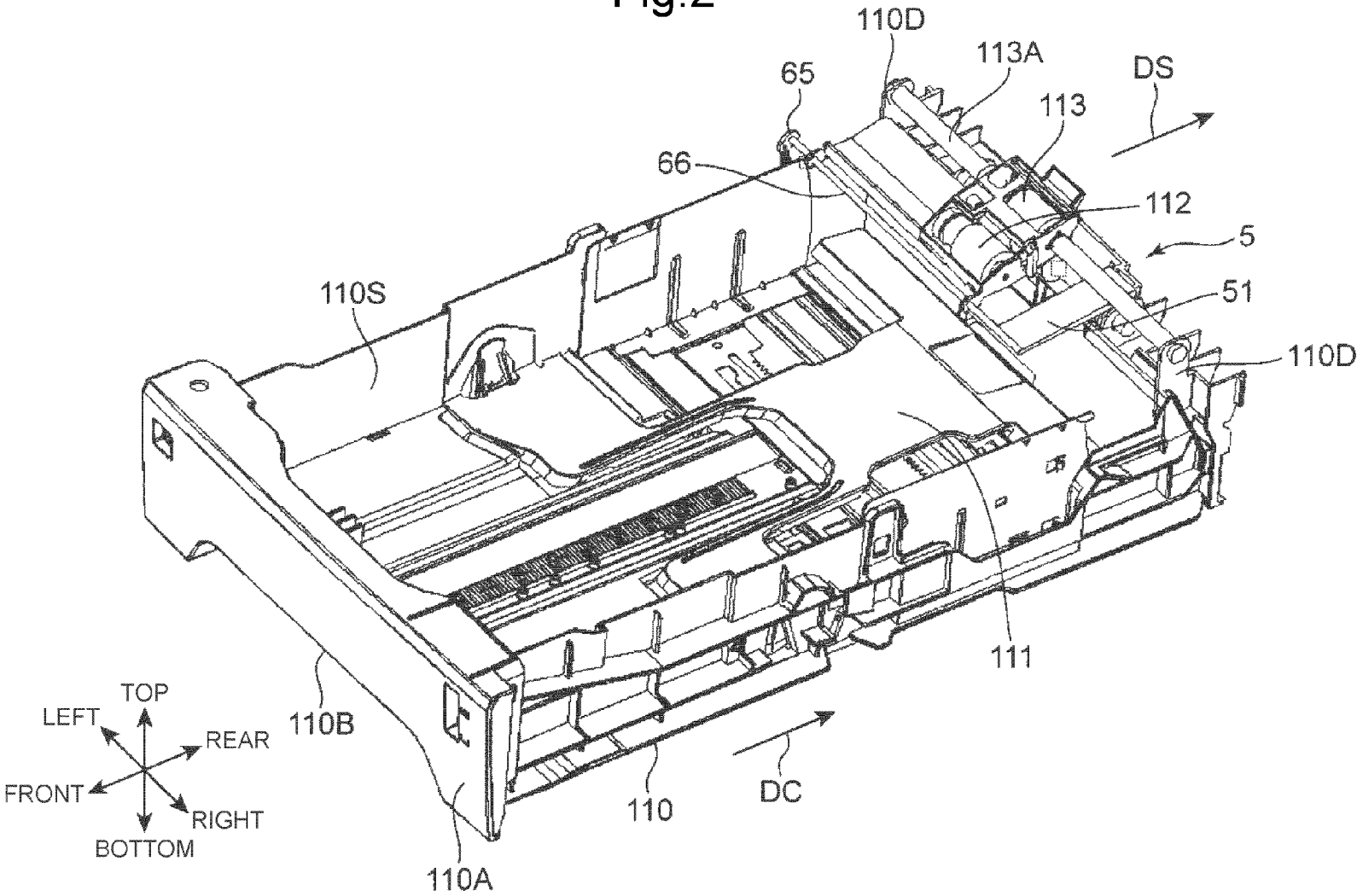
FIG. 2 is a perspective view of a cassette according to the above embodiment of the present disclosure.
Figure 3:
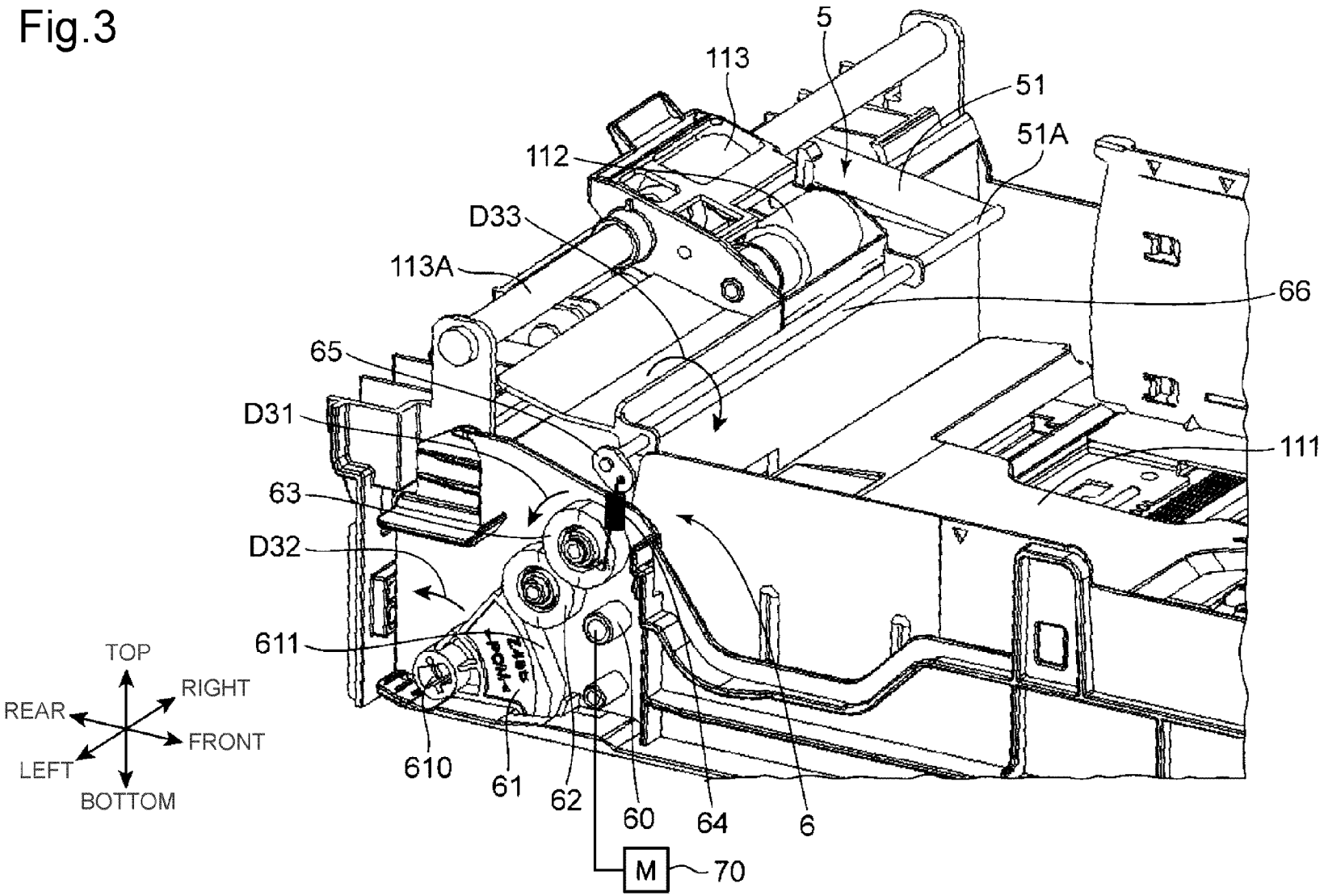
FIG. 3 is an enlarged perspective view of the cassette according to the above embodiment of the present disclosure.
Figure 4:
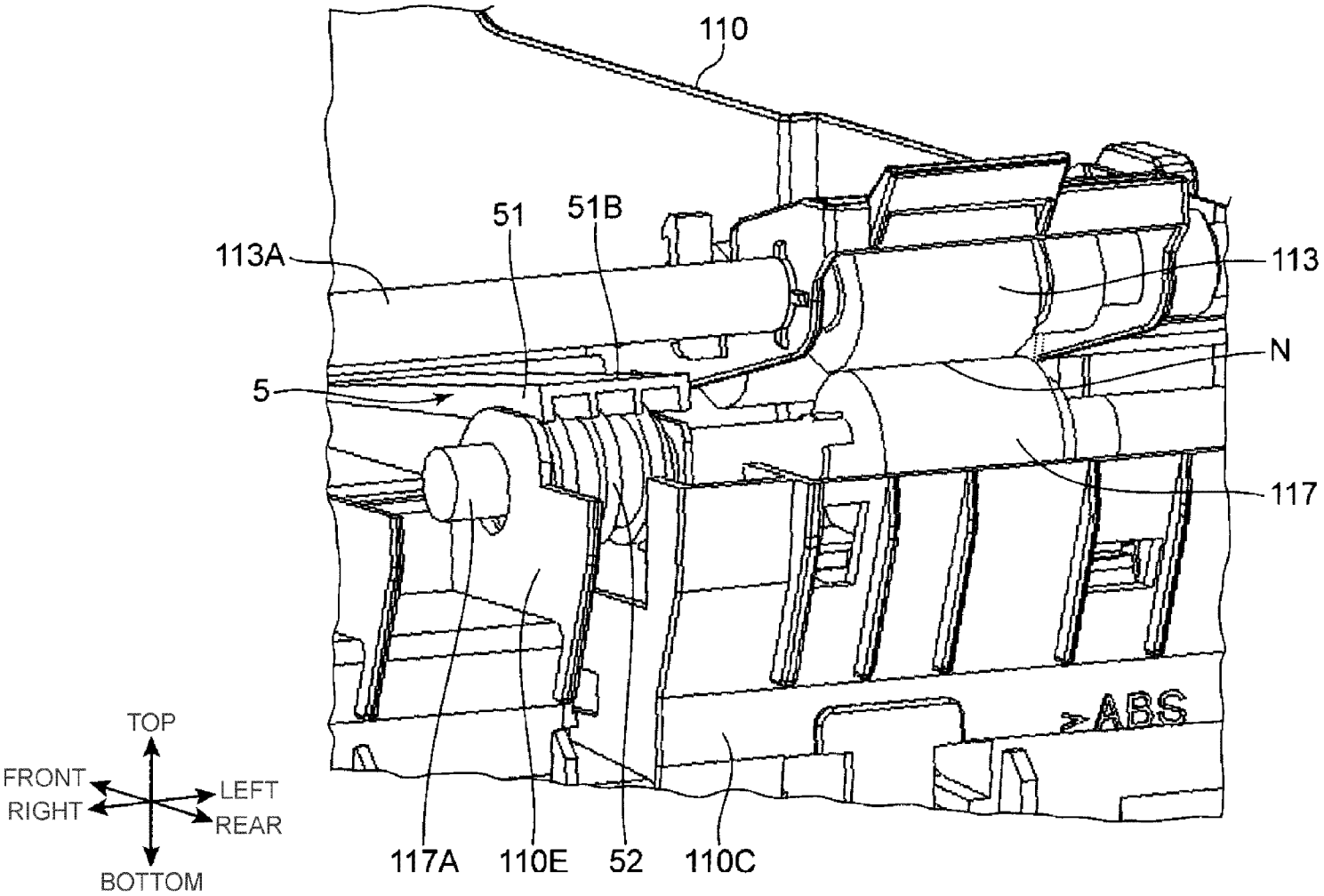
FIG. 4 is an enlarged perspective view of a paper feed nip N and the neighboring part of the cassette according to the above embodiment of the present disclosure.
Figure 5:
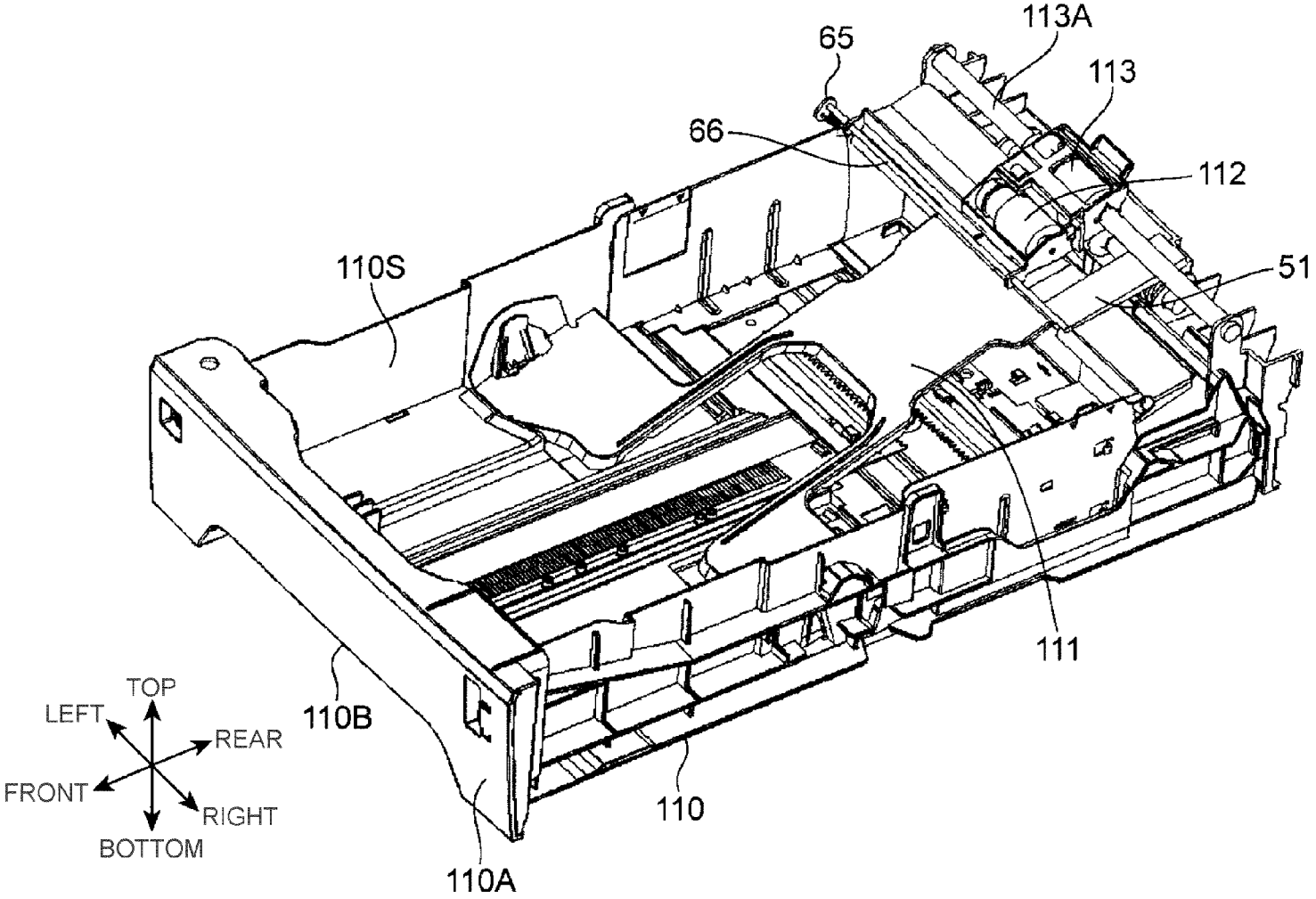
FIG. 5 is another perspective view of the cassette according to the above embodiment of the present disclosure.
Figure 6:
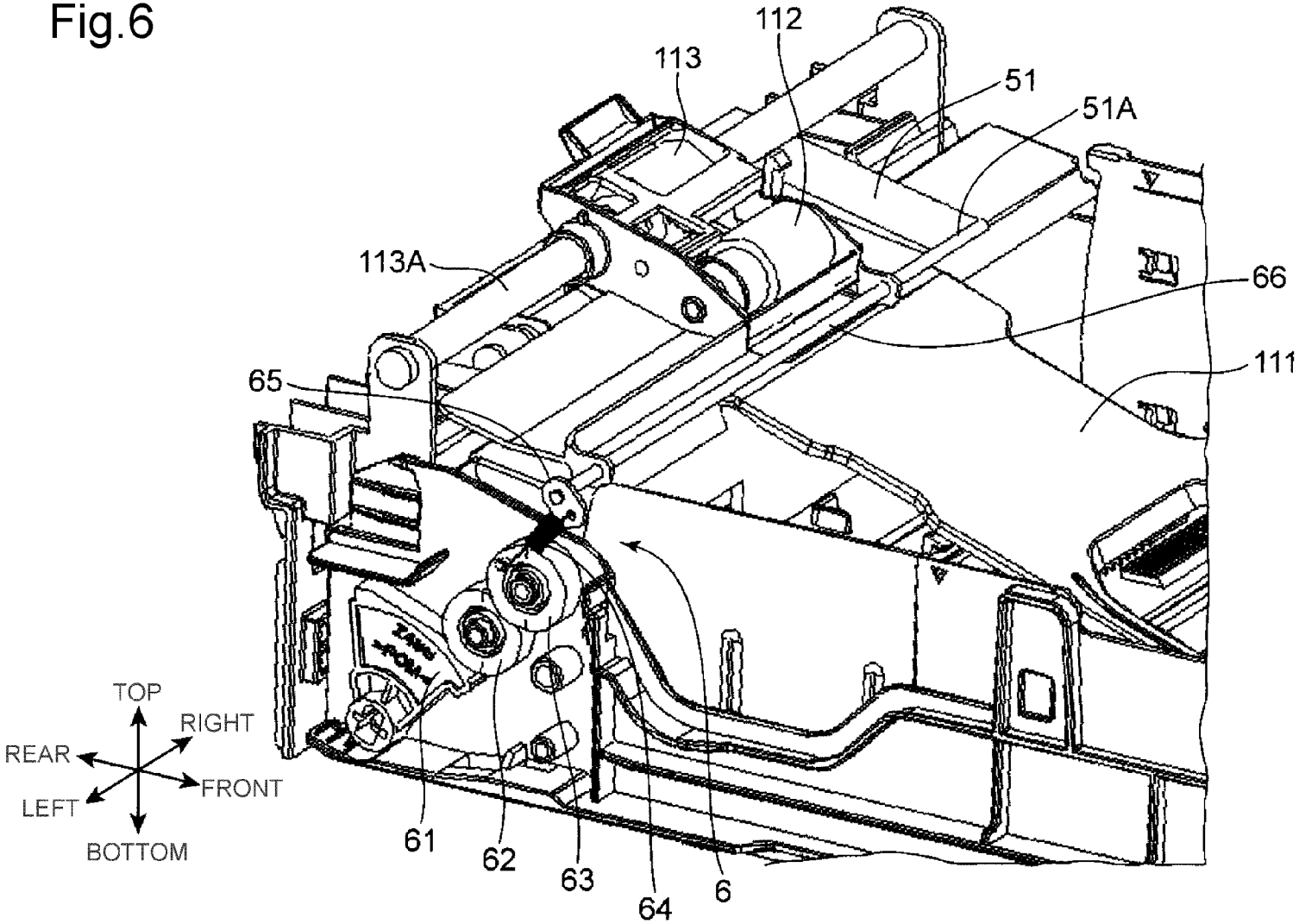
FIG. 6 is another enlarged perspective view of the cassette according to the above embodiment of the present disclosure.
Figure 7:
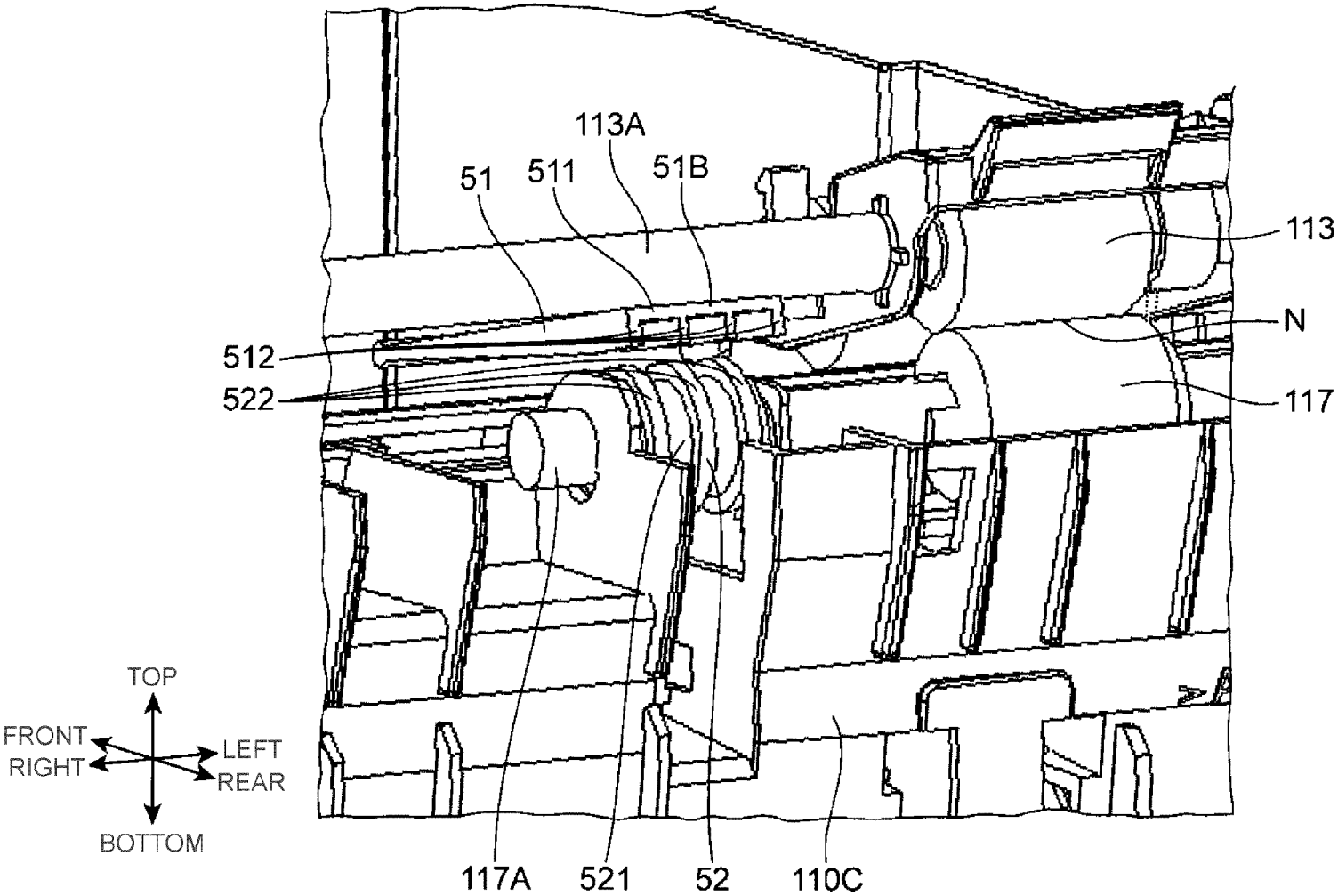
FIG. 7 is another enlarged perspective view of the paper feed nip N and the neighboring part of the cassette according to the above embodiment of the present disclosure.

Next, a detailed description will be given of the paper feed section 20 (paper feeder) according to this embodiment with reference to FIGS. 2 to 7. The paper feed section 20 includes the cassette 110 as described previously. FIGS. 2 and 5 are perspective views of the cassette 110 and FIGS. 3 and 6 are enlarged perspective views of part of the cassette 110. FIGS. 4 and 7 are enlarged perspective views of a paper feed nip N and the neighboring part of the cassette 110. FIGS. 2 to 4 correspond to a state of the cassette 110 pulled out of the body housing 10 (hereinafter, also referred to as a first state), while FIGS. 5 to 7 correspond to a state of the cassette 110 loaded in the body housing 10 and having the lift plate 111 moved up, in other words, a state of the cassette 110 in which the paper feed roller 113 is ready to convey a sheet S (hereinafter, also referred to as a second state).

The cassette 110 is capable of being loaded into and unloaded from the body housing 10 (apparatus body). In this embodiment, the cassette 110 is loaded in a direction of the arrow DC shown in FIGS. 1 and 2 (a loading direction). The cassette 110 is provided internally with a sheet container 110S in which a stack of sheets S can be contained. The sheets S contained in the sheet container 110S are conveyed along the sheet conveyance path P. The sheet conveyance path P is a conveyance path which is extended from the sheet container 110S and along which a sheet S can be conveyed in the sheet conveyance direction (a direction of the arrow DS in FIG. 2) extending along the above-mentioned loading direction. The cassette 110 is in the shape of a box in which walls rise up from the front, rear, right, and left sides of the bottom surface. The front side of the cassette 110 is defined by a cassette front end portion 110A and the rear side of the cassette 110 is defined by a cassette rear end portion 110C (see FIG. 4). The cassette front end portion 110A is provided with a cassette grip 110B formed by upwardly cutting away part of the lower edge of the cassette front end portion 110A. The user can load the cassette 110 into the body housing 10 while holding the cassette grip 110B. Furthermore, the user can unload (pull out) the cassette 110 from the body housing 10 while holding the cassette grip 110B.

The cassette 110 includes a lift plate 111, a pick-up roller 112, a paper feed roller 113, and a retard roller 117.

The lift plate 111 is disposed on the bottom part of the cassette 110 so as to be movable up and down. When the lift plate 111 is moved up, it moves an end of the stack of sheets S in the sheet container 110S, located downstream in the sheet conveyance direction, toward the paper feed roller 113. More specifically, when the lift plate 111 is move up, the downstream end of the stack of the sheets S in the sheet conveyance direction is pressed against the pick-up roller 112. The lift plate 111 can be moved up and down by a drive motor 70 to be described later.

The pick-up roller 112 is disposed above the rear end of the sheet container 110S (the downstream end thereof in the sheet conveyance direction). The pick-up roller 112 is disposed in the middle of the cassette 110 in a widthwise direction of the sheet (the right-and-left direction) intersecting with the loading direction of the cassette 110 (the front-to-rear direction). As described previously, when the lift plate 111 is move up, the downstream end of the stack of sheets S in the sheet conveyance direction is pressed against the pick-up roller 112. Then, when the pick-up roller 112 is rotated by an unshown drive device, the sheet S of the stack is conveyed downstream in the sheet conveyance direction.

The paper feed roller 113 is disposed downstream of the pick-up roller 112 in the sheet conveyance direction. The paper feed roller 113 is rotatably journaled on a paper feed roller shaft 113A. As shown in FIG. 2, the paper feed roller shaft 113A is a shaft located above the rear end of the cassette 110 and extended in the right-and-left direction. The paper feed roller shaft 113A is supported to a pair of first support walls 110D rising from right and left ends of the cassette 110. The paper feed roller 113 is disposed at the entrance of the sheet conveyance path P. When the paper feed roller 113 is driven into rotation by an unshown drive device, it conveys the sheet S forwarded by the pick-up roller 112 further downstream in the sheet conveyance direction. As just described, the cassette 110 integrally supports the paper feed roller 113, which is also a key feature of the cassette 110 according to this embodiment.

The retard roller 117 (opposed member, see FIG. 4) is disposed below and opposite to the paper feed roller 113. The retard roller 117 forms, together with the paper feed roller 113, the paper feed nip N where the sheet S enters and passes. The aforementioned sheet conveyance path P is extended from the sheet container 1105 of the cassette 110 to pass through the paper feed nip N. The retard roller 117 is rotatably journaled on a retard roller shaft 117A. The retard roller shaft 117A is supported to a pair of second support walls 110E provided on the cassette rear end portion 110C of the cassette 110. The retard roller 117 can be rotated following the rotation of the paper feed roller 113. When a plurality of sheets S enter the paper feed nip N, only the uppermost sheet S is conveyed downstream in the sheet conveyance direction by the paper feed roller 113. The other sheets S engage on the peripheral surface of the retard roller 117 and are thus stopped at the paper feed nip N.

The cassette 110 further includes a restricting member 5 and an interlocking unit 6. Furthermore, the body housing 10 is provided with a drive motor 70 (drive device) facing the cassette 110.

The restricting member 5 is disposed to the right of the paper feed roller 113. In the first state where the cassette 110 is unloaded from the body housing 10, the restricting member 5 closes off a portion of the sheet conveyance path P upstream of the paper feed nip N in the sheet conveyance direction. Thus, the restricting member 5 restricts the sheets S contained in the cassette 110 from entering the paper feed nip N. On the other hand, in the second state where the cassette 110 is loaded in the body housing 10 and the paper feed roller 113 is ready to convey the sheet S, the restricting member 5 opens the sheet conveyance path P. The restricting member 5 includes a restricting plate 51 (first member) and a restricting roller 52 (second member).

The restricting plate 51 is disposed above the sheet conveyance path P. The restricting plate 51 is located between the paper feed roller shaft 113A and the retard roller shaft 117A. A restricting plate distal end 51B located at the rear end of the restricting plate 51 is movable up and down about a restricting plate base end 51A located at the front end of the restricting plate 51 and serving as a fulcrum. Specifically, when moving down, the restricting plate 51 enters the sheet conveyance path P and becomes engageable against the restricting roller 52 to be described later. As a result, the sheet conveyance path P is closed off. The restricting plate 51 includes a base plate portion 511 and plate ribs 512 (first ribs) (see FIG. 7). The base plate portion 511 is a plate-like member forming a main body of the restricting plate 51 and extended in the sheet conveyance direction. The plate ribs 512 are a plurality of ribs projected downward from the base plate portion 511 and extended in the sheet conveyance direction. The plate ribs 512 are provided like comb teeth at intervals in the widthwise direction of the sheet intersecting with the direction of conveyance of the sheet (i.e., the loading direction of the cassette 110).

The interlocking unit 6 operates in conjunction with the upward and downward movement of the lift plate 111 driven by the after-mentioned drive motor 70 to move up and down the restricting plate 51. Specifically, with the upward movement of the lift plate 111, the interlocking unit 6 moves up the restricting plate distal end 51B of the restricting plate 51 to retreat from the sheet conveyance path P. Furthermore, with the downward movement of the lift plate 111, the interlocking unit 6 allows the restricting plate distal end 51B of the restricting plate 51 to enter the sheet conveyance path P and engage against the restricting roller 52. Referring to FIG. 3, the interlocking unit 6 is provided at a front portion of the left sidewall of the cassette 110. The interlocking unit 6 includes a sector gear 61, a first transmission gear 62, a second transmission gear 63, a biasing spring 64, a rotary piece 65, and a transmission shaft 66. The interlocking unit 6 further includes an unshown input gear rotatably mounted on an input gear shaft 60 shown in FIG. 3.

The sector gear 61 is a member in the shape of a sector. The sector gear 61 includes a fulcrum portion 610 and an arcuate portion 611. The arcuate portion 611 is rotatable about the fulcrum portion 610. The outer periphery of the arcuate portion 611 is provided with gear teeth capable of meshing engagement with the first transmission gear 62. Furthermore, the sector gear 61 is connected across the sidewall of the cassette 110 to the lift plate 111. Specifically, an unshown lifting member is mounted on the bottom of the cassette 110. The lifting member is connected across the sidewall of the cassette 110 to the sector gar 61 and allows the back surface of the lift plate 111 to bear against it. Thus, with the rotation of the sector gear 61 about the fulcrum portion 610, the lifting member moves up and down the lift plate 111.

The first transmission gear 62 is a gear which serves to transmit a rotary drive force of the input gear to the arcuate portion 611 of the sector gear 61. The second transmission gear 63 is a gear which is meshed with the first transmission gear 62 and serves to transmit the rotary drive force of the drive motor 70 to the restricting plate 51. The biasing spring 64 serves to transmit the rotary force of the second transmission gear 63 to the rotary piece 65. The lower end of the biasing spring 64 is anchored to a predetermined position of a side surface of the second transmission gear 63. On the other hand, then upper end of the biasing spring 64 is anchored to a lower portion of the rotary piece 65. The rotary piece 65 is an elliptic plate-like member disposed above the second transmission gear 63. The rotary piece 65 is connected to the transmission shaft 66. Furthermore, as described previously, the upper end of the biasing spring 64 is anchored to the lower end of the rotary piece 65. As a result, the rotation of the second transmission gear 63 is converted to the pivotal movement of the rotary piece 65. The transmission shaft 66 is a shaft member extended in the right-and-left direction. The left end of the transmission shaft 66 is connected to the upper end of the rotary piece 65. The right end of the transmission shaft 66 is connected to the restricting plate base end 51A of the restricting plate 51. Thus, the pivotal movement of the rotary piece 65 is converted to the pivotal movement of the restricting plate 51 about the restricting plate base end 51A (about the transmission shaft 66). In this manner, the restricting plate 51 pivotally moves about the transmission shaft 66 to enter or retreat from the sheet conveyance path P.

The drive motor 70 is mounted to the body housing 10. The drive motor 70 includes an unshown reduction gear. The reduction gear is meshed with the unshown input gear rotatably mounted on the input gear shaft 60 shown in FIG. 3. The rotary drive force of the drive motor 70 is transmitted from the reduction gear through the input gear to the cassette 110. The drive motor 70 generates a drive force allowing the lift plate 111 to move up and down. Furthermore, the drive force generated by the drive motor 70 is converted to upward and downward movement of the restricting plate 51 by the interlocking unit 6. Although in FIG. 3 the drive motor 70 is connected to the input gear shaft 60 for sake of simplicity, the unshown reduction gear disposed on the drive motor 70 is in reality meshed with the unshown input gear rotatably supported on the input gear shaft 60 as described above.

Figure 8:
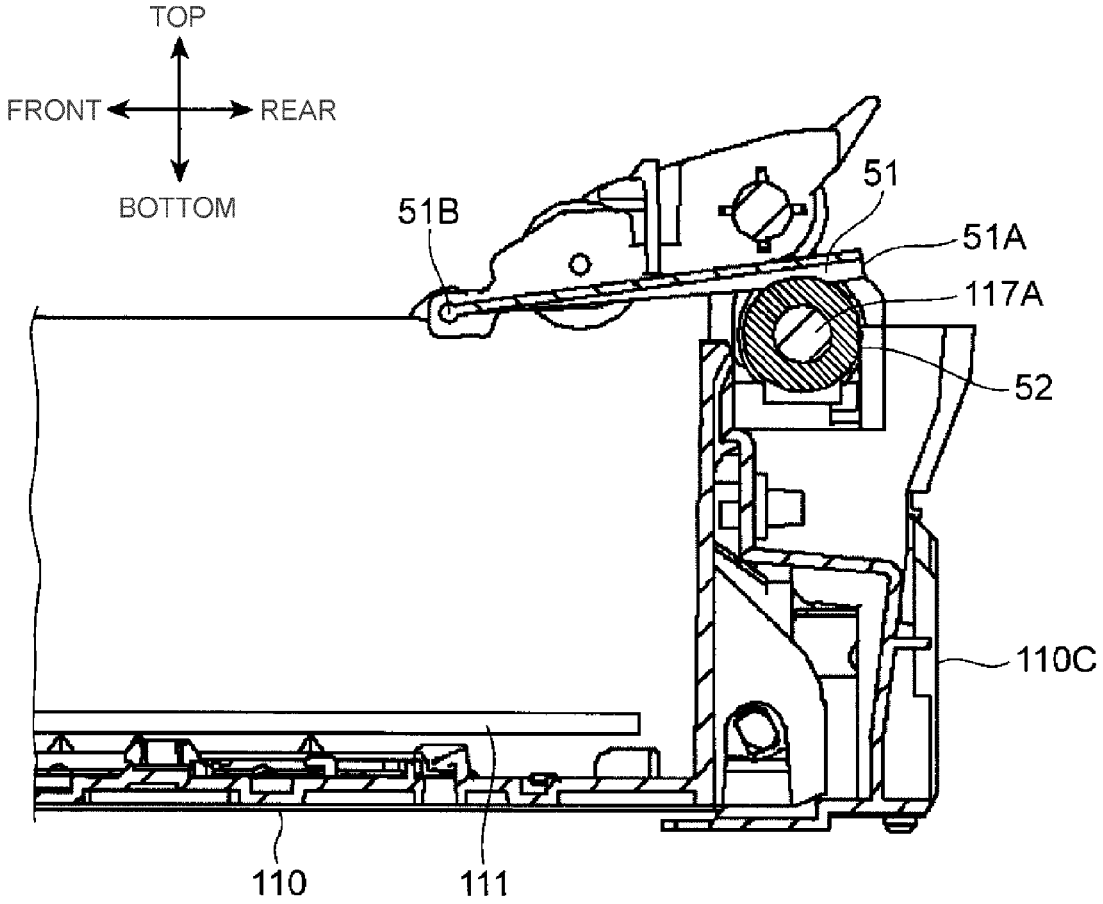
FIG. 8 is an enlarged cross-sectional view of the cassette according to the above embodiment of the present disclosure.

Next, a description will be given of the operation of the cassette 110 according to this embodiment. FIG. 8 is a cross-sectional view showing a state in which the restricting plate 51 is mating with the restricting roller 52. Referring to FIGS. 1 and 2, after the cassette 110 is pulled out of the body housing 10, the user places sheets S in the sheet container 110S of the cassette 110. In doing so, as shown in FIG. 2, the lift plate 111 is positioned in a lowermost position close to the bottom of the cassette 110.

Meanwhile, in the restricting member 5, as shown in FIG. 4, the restricting plate distal end portion 51B of the restricting plate 51 is positioned in the lower position to engage against the restricting roller 52 (see FIG. 8). The plate ribs 512 of the restricting plate 51 and roller ribs 522 of the restricting roller 52 are alternately arranged in the widthwise direction of the sheet. Therefore, the sheet conveyance path P is closed off by the mating of the plate ribs 512 with the roller ribs 522. The position of mating of the plate ribs 512 with the roller ribs 522 in the sheet conveyance of direction (the front-to-rear direction) is located at a position overlapping the paper feed nip N or upstream of the paper feed nip N. Thus, even if the cassette 110 is inserted hard into the body housing 10, it can be prevented that some of the sheets S stacked in full load condition in the sheet container 110S of the cassette 110 enter the paper feed nip N. Particularly, since the restricting roller 52 opposed to the restricting plate 51 has a roller shape, a wedge-shaped space is created upstream of the position of mating of the plate ribs 512 with the roller ribs 522 in the sheet conveyance direction. Therefore, the leading ends of the sheets S are restricted while entering the space, so that the leading ends can be prevented from being damaged.

When the cassette 110 is loaded in the body housing 10, the drive motor 70 is actuated by an unshown control section. Thus, the first transmission gear 62 is rotated and then the second transmission gear 63 is rotated in the direction of the arrow D31 in FIG. 3. Concurrently, the sector gear 61 is rotated about the fulcrum portion 610 (in the direction of the arrow D32 in FIG. 3). As a result, the sector gear 61 is positioned in a position shown in FIG. 6 and the lift plate 111 is moved up by the lifting member connected to the sector gear 61. The drive motor 70 is operated until the uppermost of the sheets S stacked in the sheet container 110S is pressed against the peripheral surface of the pick-up roller 112.

Concurrently with the upward movement of the lift plate 111, the rotation of the second transmission gear 63 changes the biasing direction of the biasing spring 64. Specifically, as the second transmission gear 63 rotates, the biasing spring 64 anchored at the lower end to the side surface of the second transmission gear 63 is moved from the position in FIG. 3 to the position in FIG. 6. As a result, the transmission shaft 66 connected to the rotary piece 65 is rotated in the direction of the arrow D33 in FIG. 3. This rotation of the transmission shaft 66 is converted to the movement of the restricting plate 51 connected to the transmission shaft 66. Specifically, the restricting plate distal end 51B of the restricting plate 51 is pivotally moved up about the restricting plate base end 51A connected to the transmission shaft 66 and serving as a fulcrum. As a result, the restricting plate 51 is moved upward away from the restricting roller 52, so that the sheet conveyance path P is opened. Therefore, the sheet S forwarded by the pick-up roller 112 can enter the paper feed nip N without being restricted by the restricting member 5.

When the sheet feeding of the pick-up roller 112 and the paper feed roller 113 is terminated by the end of an image forming operation of the image forming apparatus 1, some of the sheets S may be nipped by the paper feed nip N and stopped with their leading ends downstream in the sheet conveyance direction projecting downstream beyond the paper feed nip N. If the cassette 110 were pulled out of the body housing 10 as it were, the sheets S might become stuck in the body housing 10. In contrast, in this embodiment, the drive motor 70 is rotated reversely before the cassette 110 is pulled out of the body housing 10, so that the lift plate 111 is moved down. The interlocking unit 6 operates in conjunction with the downward movement of the lift plate 111 to allow the restricting plate 51 to engage against the restricting roller 52 again. At this time, the sheets S nipped by the paper feed nip N are held between the restricting plate 51 and the restricting roller 52. Thus, while the cassette 110 is pulled out of the body housing 10, the restricting member 5 can pull out the sheet S in a direction of pulling of the cassette 110 (a direction opposite to the loading direction). In another embodiment, the cassette 110 may be configured so that while the cassette 110 is pulled out of the body housing 10, the mating of the reduction gear of the drive motor 70 with the input gear is disengaged and the lift plate 111 moves down under its own weight.

While the pick-up roller 112 and the paper feed roller 113 operate for sheet feeding, the retard roller 117 is rotated following the rotation of the paper feed roller 113. On the other hand, when the sheet feeding is terminated, the retard roller 117 is driven into rotation reversely to the rotation following the paper feed roller 113 by an unshown drive device. Thus, the sheets S nipped by the paper feed nip N are conveyed back to the sheet container 1105. Therefore, the sticking of the sheet S in the body housing 10 can be further prevented.

As thus far described, in the paper feeder according to the one embodiment of the present disclosure, the cassette 11 is capable of being loaded into and unloaded from the body housing 10 (apparatus body) in the predetermined direction and internally provided with the sheet container 1105 in which sheets are to be contained. The sheet conveyance path P is extended from the sheet container 1105 and the sheet can be conveyed along the sheet conveyance path P in the sheet conveyance direction which extends along the direction of loading and unloading of the cassette 110. The paper feed roller 113 is mounted to the cassette 110 at the entrance of the sheet conveyance path P and configured to convey the sheet in the sheet conveyance direction. The retard roller 117 (opposed member) is disposed opposite to the paper feed roller 113 and forms, together with the paper feed roller 113, the paper feed nip N where the sheet S enters. The restricting member 5 is configured to, in the first state where the cassette 110 is unloaded from the body housing 10 (apparatus body), close off a portion of the sheet conveyance path P upstream of the paper feed nip N in the sheet conveyance direction to restrict the sheet in the sheet container 1105 from entering the paper feed nip N and, in the second state where the cassette 110 is loaded in the body housing 10 and the paper feed roller 113 is ready to convey the sheet, open the sheet conveyance path P to allow the sheet enter the paper feed nip.

With the above structure, the cassette 110 is capable of being loaded into and unloaded from the body housing 10 in the predetermined direction. When the cassette 110 is loaded in the body housing 10, the sheet S contained in the sheet container 110S can be conveyed through the paper feed nip N located between the paper feed roller 113 and the retard roller 117 in the sheet conveyance direction extending along the direction of loading and unloading. If the cassette 110 is loaded hard into the body housing 10, some of the sheet S contained in the sheet container 110S may enter the paper feed nip N. Even in this case, in the first state where the cassette 110 is unloaded from the body housing 10, the restricting member 5 closes off the portion of the sheet conveyance path P upstream of the paper feed nip N in the sheet conveyance direction to restrict the sheet S contained in the cassette 110 from entering the paper feed nip N. Furthermore, in the second state where the cassette 110 is loaded in the body housing 10 and the paper feed roller 113 is ready to convey the sheet S, the restricting member 5 opens the sheet conveyance path P. Therefore, it can be prevented that before the paper feed roller 113 conveys the sheet S, the sheet S in the sheet container 110S enters the paper feed nip N. Then, after the restricting member 5 opens the sheet conveyance path P, the sheet S is stably conveyed by the paper feed roller 113.

In the paper feeder according to the one embodiment of the present disclosure, the restricting member 5 includes: a restricting plate 51 (first member) disposed above the sheet conveyance path P; and a restricting roller 52 (second member) disposed below the sheet conveyance path P and across the sheet conveyance path P from the restricting plate 51. Furthermore, when one or both of the restricting plate 51 and the restricting roller 52 are moved to enter the sheet conveyance path P, the sheet conveyance path P is closed off.

With the above structure, the restricting plate 51 and the restricting roller 52 are arranged to interpose the sheet conveyance path P therebetween. Furthermore, when the restricting plate 51 is moved to enter the sheet conveyance path P, the sheet conveyance path P is closed off. As a result, the sheet conveyance path P is surely closed off by the restricting plate 51 and the restricting roller 52.

In the paper feeder according to the one embodiment of the present disclosure, the restricting plate 51 (first member) includes a plurality of plate ribs 512 (first ribs) projected toward the sheet conveyance path P and arranged like comb teeth at intervals in the widthwise direction of the sheet intersecting with the sheet conveyance direction. The restricting roller 52 (second member) includes a plurality of roller ribs 522 (second ribs) projected toward the sheet conveyance path P and arranged like comb teeth at intervals in the widthwise direction of the sheet. At least one of the roller ribs 522 is positioned between each adjacent two of the plate ribs 512 in the first state.

In the above structure, with the movement of the restricting plate 51, the plurality of plate ribs 512 mate with the plurality of roller ribs 522 to surely close off the sheet conveyance path P.

In the paper feeder according to the one embodiment of the present disclosure, the restricting plate 51 (first member) further includes a base plate portion 511 extended in the sheet conveyance direction. Furthermore, the plurality of plate ribs 512 (first ribs) are projected from the base plate portion 511. The restricting roller 52 (second member) further includes a shaft portion extended in the widthwise direction of the sheet and a roller portion 521 disposed around the shaft portion. Furthermore, the plurality of roller ribs 522 (second ribs) are projected from the outer peripheral surface of the roller portion 521 and extended along the circumferential direction thereof.

With the above structure, the plurality of plate ribs 512 are projected from the base plate portion 511 of the restricting plate 51. Furthermore, the plurality of roller ribs 522 are projected from the outer peripheral surface of the roller portion 521 of the restricting roller 52 along the circumferential direction thereof. Therefore, when the plate ribs 512 mate with the roller ribs 522, a wedge-shaped space is created between the base plate portion 511 and the outer peripheral surface of the roller portion 521 in cross-sectional view intersecting with the widthwise direction of the sheet. Thus, the wedge-shaped space blocks the leading ends of the sheets S from entering the paper feed nip N. At this time, the leading ends of the sheets S can be prevented from being folded.

In the paper feeder according to the one embodiment of the present disclosure, the plate ribs 512 (first ribs) and the roller ribs 522 (second ribs) mate with each other in the first state where the cassette 110 is unloaded from the body housing 10 (apparatus body). In addition, the position of mating of the plate ribs 512 with the roller ribs 522 is located at a position partially overlapping the paper feed nip N or upstream of the paper feed nip N in the sheet conveyance direction.

With the above structure, even if the cassette 110 is inserted hard into the body housing 10, it can be prevented that some of the sheets S stacked in full load condition in the sheet container 110S of the cassette 110 enter the paper feed nip N.

The paper feeder according to the one embodiment of the present disclosure includes: a lift plate 111 disposed on the bottom part of the cassette 110 so as to be movable up and down and move an end of the sheet in the sheet container 110S, downstream in the sheet conveyance direction, toward the paper feed roller 113; a drive motor 70 (drive device) configured to generate a drive force allowing the lift plate 111 to move up and down; and an interlocking unit 6 configured to operate in conjunction with the upward and downward movement of the lift plate 111 driven by the drive motor 70 to allow the restricting plate 51 (first member) or the restricting roller 52 (second member) to enter and retreat from the sheet conveyance path P.

With the above structure, the interlocking unit 6 allows the restricting plate 51 to move in conjunction with the upward and downward movement of the lift plate 111.

In the paper feeder according to the one embodiment of the present disclosure, the interlocking unit 6 includes a transmission shaft 66 connected to the base end 51A of the restricting plate 51 (first member) and is configured to rotate the transmission shaft 66 in conjunction with the upward and downward movement of the lift plate 111 driven by the drive motor 70 (drive device) to allow the restricting plate 51 to pivotally move about the transmission shaft 66 and thereby enter and retreat from the sheet conveyance path P.

With the above structure, by rotating the transmission shaft 66 in conjunction with the upward and downward movement of the lift plate 111, the restricting plate 51 can be allowed to enter and retreat from the sheet conveyance path P.

In the paper feeder according to the one embodiment of the present disclosure, the interlocking unit 6 is configured to, with the upward movement of the lift plate 111, allow the restricting plate 51 (first member) or the restricting roller 52 (second member) to retreat from the sheet conveyance path P and, with the downward movement of the lift plate 111, allow the restricting plate 51 or the restricting roller 52 to enter the sheet conveyance path P.

With the above structure, when the lift plate 111 moves down so that no further sheet S is fed, the sheet conveyance path P is closed off by the restricting plate 51 and the restricting roller 52. On the other hand, when the lift plate 111 moves up so that the sheet S can be fed, the sheet conveyance path P is opened.

In the paper feeder according to the one embodiment of the present disclosure, the retard roller 117 (opposed member) is disposed opposite to the paper feed roller 113 to prevent a plurality of sheets S from being conveyed by the paper feed roller 113.

With the above structure, since the retard roller 117 is opposed to the paper feed roller 113, this prevents a plurality of sheets S from being conveyed at a time by the paper feed roller 113.

In the paper feeder according to the one embodiment of the present disclosure, after the end of the sheet feed operation in which the paper feed roller 113 conveys the sheet, the retard roller 117 (opposed member) is driven into rotation reversely to the rotation following the rotation of the paper feed roller 113.

With the above structure, even if the sheet feed operation of the paper feed roller 113 is terminated as a plurality of sheets S enter the paper feed nip N, the sheets S nipped by the paper feed nip N can be conveyed back to the sheet container 110S by the reverse rotation of the retard roller 117 (opposed member). Therefore, it can be prevented that when the cassette 110 is pulled out of the body housing 10 after the sheet feed operation, the sheets S become stuck in the body housing 10.

In the paper feeder according to the one embodiment of the present disclosure, the retard roller 117 (opposed member) is a roller which is disposed opposite to the paper feed roller 113, includes a retard roller shaft 117A (first shaft), and is rotatable about the retard roller shaft 117A. The shaft portion of the restricting roller 52 (second member) is the retard roller shaft 117A of the retard roller 117 (opposed member).

With the above structure, space saving can be achieved in terms of the placement of the restricting roller 52 and the paper feeder 20 can be reduced in cost. In the case where the roller portion 521 is rotatably supported on the retard roller shaft 117A, the resistance of the sheet to conveyance can be reduced.

In the paper feeder according to the one embodiment of the present disclosure, the paper feed roller 113 includes a paper feed roller shaft 113A (second shaft) and is configured to rotate about the paper feed roller shaft 113A. Furthermore, the restricting plate 51 (first member) is disposed in a space between the retard roller shaft 117A (first shaft) and the paper feed roller shaft 113A (second shaft) and configured so that when the restricting plate 51 is moved to enter the sheet conveyance path P, the sheet conveyance path P is closed off.

With the above structure, the restricting plate 51 can be disposed using the space between the retard roller shaft 117A and the paper feed roller shaft 113A.

In the paper feeder according to the one embodiment of the present disclosure, the plate ribs 512 (first ribs) and the roller ribs 522 (second ribs) are formed along the sheet conveyance direction.

With the above structure, the plate ribs 512 and the roller ribs 522 can facilitate the conveyance of the sheet in the sheet conveyance direction.

The image forming apparatus according to the one embodiment of the present disclosure includes: the aforementioned paper feeder; a body housing 10 (apparatus body) capable of loading the cassette 110 therein; and an image forming section 30 disposed in the body housing 10 and configured to form an image on the sheet conveyed by the paper feed roller 113.

With the above structure, it can be prevented that before the paper feed roller 113 conveys the sheet, the sheet in the sheet container 110S enters the paper feed nip N. Then, after the restricting member 5 opens the sheet conveyance path P, the sheet is stably conveyed by the paper feed roller 113. This enables stable feeding of the sheet toward the image forming section 30. In addition, even if the cassette 110 is loaded hard into the body housing 10, it can be prevented that the sheet rushes into the paper feed nip N and its leading end is thus damaged.

A technique is known in which the movement of sheets in the apparatus body is restricted by an interlocking mechanism disposed across the sheet cassette and the apparatus body. However, if a plurality of members constituting the interlocking mechanism are arranged between the apparatus body and the sheet cassette, the occurrence of failure of connection between the members may interfere with the accurate restriction of movement of the sheet.

The above paper feeder and the image forming apparatus according to the one embodiment of the present disclosure can accurately restrict the movement of the sheet and can prevent the sheet from entering the paper feed nip upon loading of the sheet cassette into the apparatus body.

Although the cassette 110 and the image forming apparatus 1 with the same according to the embodiment of the present disclosure have thus far been described, the present disclosure is not limited to the above embodiment and can take, for example, the following modified embodiments.

(1) Although the above embodiment has described an aspect in which the restricting plate 51 is moved down to close off the sheet conveyance path P, the present disclosure is not limited to this. Both of the restricting plate 51 and the restricting roller 52 may be moved to enter the sheet conveyance path P or the restricting roller 52 may be moved up. Alternatively, a plate-like member similar to the restricting plate 51 may be disposed instead of the restricting roller 52. Still alternatively, a roller member similar to the restricting roller 52 may be disposed instead of the restricting plate 51.

(2) Although the above embodiment has described an aspect in which the restricting plate 51 is moved by the interlocking unit 6, the present disclosure is not limited to this. The restricting plate 51 may be moved by an independent drive device, such as an electromagnetic solenoid. Furthermore, the restricting plate 51 or the restricting roller 52 is not limited to that configured to be moved in conjunction with the upward and downward movement of the cassette 110. For example, a predetermined time after the cassette 110 is loaded into the body housing 10, the restricting member 5 may open the sheet conveyance path P.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A paper feeder comprising:

a cassette capable of being loaded into and unloaded from an apparatus body in a predetermined direction, the cassette being provided internally with a sheet container in which sheets are to be contained;

a sheet conveyance path which is extended from the sheet container and along which the sheet is to be conveyed in a sheet conveyance direction, the sheet conveyance direction extending along a direction of loading and unloading of the cassette;

a paper feed roller mounted to the cassette at an entrance of the sheet conveyance path and configured to convey the sheet in the sheet conveyance direction;

an opposed member disposed opposite to the paper feed roller and forming, together with the paper feed roller, a paper feed nip where the sheet enters; and, a restricting member including a first member disposed above the sheet conveyance path and a second member disposed below the sheet conveyance path and across the sheet conveyance path from the first member, wherein the restricting member configured to, in a first state where the cassette is unloaded from the apparatus body, when one or both of the first member and the second member are moved to enter the sheet conveyance path, close off a portion of the sheet conveyance path upstream of the paper feed nip in the sheet conveyance direction to restrict the sheet in the sheet container from entering the paper feed nip upon loading of the cassette into the apparatus body and, in a second state where the cassette has been loaded in the apparatus body and the paper feed roller is capable of conveying the sheet, open the sheet conveyance path to allow the sheet enter the paper feed nip.

2. The paper feeder according to claim 1, wherein the first member includes a plurality of first ribs projected toward the sheet conveyance path and arranged like comb teeth at intervals in a sheet widthwise direction of intersecting with the sheet conveyance direction, and the second member includes a plurality of second ribs projected toward the sheet conveyance path and arranged like comb teeth at intervals in the widthwise direction of the sheet, with at least one of the second ribs positioned between each adjacent two of the first ribs in the first state.

3. The paper feeder according to claim 2, wherein the first member further includes a base plate portion extended in the sheet conveyance direction, with the plurality of first ribs projected from the base plate portion, and the second member further includes a shaft portion extended in the widthwise direction of the sheet and a roller portion disposed around the shaft portion, with the plurality of second ribs projected from an outer peripheral surface of the roller portion and extended along a circumferential direction of the roller portion.

4. The paper feeder according to claim 2, wherein the first ribs and the second ribs mate with each other in the first state, and the position of mating of the first ribs with the second ribs is located at a position partially overlapping the paper feed nip or upstream of the paper feed nip in the sheet conveyance direction.

5. The paper feeder according to claim 3, wherein the opposed member is a retard roller which is disposed opposite to the paper feed roller, includes a first shaft, and is rotatable about the first shaft, and the shaft portion of the second member is the first shaft of the retard roller.

6. The paper feeder according to claim 3, wherein the first ribs and the second ribs are formed along the sheet conveyance direction.

7. The paper feeder according to claim 1, further comprising:

a lift plate disposed on a bottom part of the cassette so as to be movable up and down and move an end of the sheet in the sheet container, downstream in the sheet conveyance direction, toward the paper feed roller;

a drive device configured to generate a drive force allowing the lift plate to move up and down; and an interlocking unit configured to operate in conjunction with upward and downward movement of the lift plate driven by the drive device to allow the first member or the second member to enter and retreat from the sheet conveyance path.

8. The paper feeder according to claim 7, wherein the interlocking unit includes a transmission shaft connected to a base end of the first member and is configured to rotate the transmission shaft in conjunction with the upward and downward movement of the lift plate driven by the drive device to allow the first member to pivotally move about the transmission shaft and thereby enter and retreat from the sheet conveyance path.

9. The paper feeder according to claim 7, wherein the interlocking unit is configured to, with the upward movement of the lift plate, allow the first member or the second member to retreat from the sheet conveyance path and, with the downward movement of the lift plate, allow the first member or the second member to enter the sheet conveyance path.

10. The paper feeder according to claim 9, wherein after a sheet feed operation in which the paper feed roller conveys the sheet, the retard roller is driven into rotation reversely to the rotation following the rotation of the paper feed roller.

11. The paper feeder according to claim 10, wherein the paper feed roller includes a second shaft and is configured to rotate about the second shaft, and the first member is disposed in a space between the first shaft and the second shaft and configured so that when the first member is moved to enter the sheet conveyance path, the sheet conveyance path is closed off.

12. The paper feeder according to claim 1, wherein the opposed member is a retard roller disposed opposite to the paper feed roller to prevent a plurality of sheets from being conveyed by the paper feed roller.

13. An image forming apparatus comprising a paper feeder, an apparatus body, and an image forming section, wherein the paper feeder includes:

a cassette capable of being loaded into and unloaded from the apparatus body in a predetermined direction, the cassette being provided internally with a sheet container in which sheets are to be contained;

a sheet conveyance path which is extended from the sheet container and along which the sheet is to be conveyed in a sheet conveyance direction which is a same direction with a direction of loading and unloading of the cassette;

a paper feed roller mounted to the cassette at an entrance of the sheet conveyance path and configured to convey the sheet in the sheet conveyance direction;

an opposed member disposed opposite to the paper feed roller and forming, together with the paper feed roller, a paper feed nip where the sheet enters; and a restricting member including a first member disposed above the sheet conveyance path and a second member disposed below the sheet conveyance path and across the sheet conveyance path from the first member, wherein the restricting member configured to, in a first state where the cassette is unloaded from the apparatus body, when one or both of the first member and the second member are moved to enter the sheet conveyance path, close off a portion of the sheet conveyance path upstream of the paper feed nip in the sheet conveyance direction to restrict the sheet in the sheet container from entering the paper feed nip upon loading of the cassette into the apparatus body and, in a second state where the cassette has been loaded in the apparatus body and the paper feed roller is capable of conveying the sheet, open the sheet conveyance path to allow the sheet enter the paper feed nip; and, the apparatus body is capable of loading the cassette therein, and the image forming section is disposed in the apparatus body and configured to form an image on the sheet conveyed by the paper feed roller.

* * * * *